US010352210B2

(12) United States Patent
Hanschen et al.

(10) Patent No.: US 10,352,210 B2
(45) Date of Patent: Jul. 16, 2019

(54) ACOUSTIC DEVICE

(71) Applicant: 3M INNOVATIVE PROPERTIES COMPANY, St. Paul, MN (US)

(72) Inventors: Thomas P. Hanschen, Mendota Heights, MN (US); Jonathan H. Alexander, Roseville, MN (US); Paul A. Martinson, Maplewood, MN (US); John Stuart Bolton, Lafayette, IN (US); Seungkyu Lee, Woodbury, MN (US); Thomas Herdtle, Inver Grove Heights, MN (US); Ronald W. Gerdes, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/503,906

(22) PCT Filed: Sep. 9, 2015

(86) PCT No.: PCT/US2015/049111
§ 371 (c)(1),
(2) Date: Feb. 14, 2017

(87) PCT Pub. No.: WO2016/040431
PCT Pub. Date: Mar. 17, 2016

(65) Prior Publication Data

US 2017/0241310 A1 Aug. 24, 2017

Related U.S. Application Data

(60) Provisional application No. 62/048,153, filed on Sep. 9, 2014.

(51) Int. Cl.
*F01N 1/02* (2006.01)
*F01N 1/00* (2006.01)
(Continued)

(52) U.S. Cl.
CPC ..... *F01N 1/006* (2013.01); *F01N 1/026* (2013.01); *F01N 13/02* (2013.01);
(Continued)

(58) Field of Classification Search
CPC ..... F01N 1/003; F01N 1/006; F01N 1/026; F01N 2470/02; F01N 2470/04
See application file for complete search history.

(56) References Cited

U.S. PATENT DOCUMENTS 3,396,813 A * 8/1968 Hall ..... F01N 1/003 181/282
3,920,095 A 11/1975 Clark
(Continued)

FOREIGN PATENT DOCUMENTS

CN 2062891 9/1990
CN 201433804 3/2010
(Continued)

OTHER PUBLICATIONS

Jaouen, "Acoustical characterization of perforated facings," Journal of the Acoustical Society of America, 2011, vol. 129, No. 3, pp. 1400-1406.
(Continued)

*Primary Examiner* — Edgardo San Martin
(74) *Attorney, Agent, or Firm* — Philip P. Soo; Harold C. Knecht, III

(57) ABSTRACT

Provided acoustic devices include an external housing defining an expansion chamber and a wall extending through and partitioning the expansion chamber into a central chamber and a peripheral chamber adjacent the central chamber, wherein an inlet and outlet communicate with the central chamber, and wherein the wall includes a plurality of apertures formed therethrough to allow air movement to and from the central and expansion chambers, the plurality of
(Continued)

apertures sized to provide an average flow resistance ranging from 100 MKS Rayls to 5000 MKS Rayls. The acoustic devices advantageously show significant sound attenuation while streamlining air flow to reduce pressure drop across the expansion chamber.

18 Claims, 6 Drawing Sheets

(51) Int. Cl.

| | |
|---|---|
| ***F02M 35/12*** | (2006.01) |
| ***G10K 11/16*** | (2006.01) |
| ***F01N 13/02*** | (2010.01) |
| ***F24F 13/24*** | (2006.01) |

(52) U.S. Cl.
CPC .... *F02M 35/1216* (2013.01); *F02M 35/1255* (2013.01); *F24F 13/24* (2013.01); *G10K 11/161* (2013.01); *F01N 2470/02* (2013.01); *F01N 2470/24* (2013.01); *F01N 2490/155* (2013.01); *F24F 2013/245* (2013.01)

(56) References Cited

U.S. PATENT DOCUMENTS

| | | | | |
|---|---|---|---|---|
| 3,955,643 | A * | 5/1976 | Clark | F01N 1/00 181/248 |
| 5,162,620 | A * | 11/1992 | Ross | F01D 25/30 181/220 |
| 5,498,127 | A | 3/1996 | Kraft et al. | |
| 6,241,044 | B1 * | 6/2001 | Nishiyama | F01N 1/083 181/227 |
| 6,598,701 | B1 * | 7/2003 | Wood | G10K 11/162 181/284 |
| 6,617,002 | B2 | 9/2003 | Wood | |
| 6,684,842 | B1 | 2/2004 | Hellie et al. | |
| 6,977,109 | B1 | 12/2005 | Wood | |
| 7,730,996 | B2 * | 6/2010 | Van De Flier | B60K 13/04 181/246 |
| 7,731,878 | B2 | 6/2010 | Wood | |
| 8,424,636 | B2 * | 4/2013 | Jones | F01N 1/006 181/212 |
| 8,505,682 | B2 | 8/2013 | Jones | |
| 2003/0098200 | A1 * | 5/2003 | Clark | F24F 13/02 181/292 |
| 2007/0157598 | A1 * | 7/2007 | Atanas | B29C 49/4242 60/272 |
| 2007/0158135 | A1 | 7/2007 | Shimomura | |

FOREIGN PATENT DOCUMENTS

| | | | | |
|---|---|---|---|---|
| CN | 202483685 | | 10/2012 | |
| CN | 103321716 | | 9/2013 | |
| CN | 103670602 | | 3/2014 | |
| CN | 103671071 | | 3/2014 | |
| DE | 102010002112 | A1 * | 8/2011 | F24F 13/24 |
| EP | 1507071 | | 2/2005 | |
| EP | 1953354 | | 8/2008 | |
| IN | 0873/MUM/2010 | | 2/2013 | |
| KR | 20120118149 | | 10/2012 | |
| KR | 20130008321 | | 1/2013 | |
| WO | WO 91/08379 | | 6/1991 | |

OTHER PUBLICATIONS

Lee, "Design of multi-chamber silencers with microperforated elements," Noise Conference, 2014, pp. 1-12.

International Search Report for PCT International Application No. PCT/US2015/049111, dated Dec. 2, 2015, 5 pages.

* cited by examiner

ACOUSTIC DEVICE

CROSS REFERENCE TO RELATED APPLICATIONS

This application is a national stage filing under 35 U.S.C. 371 of PCT/US2015/049111, filed Sep. 9, 2015, which claims the benefit of U.S. Provisional Application No. 62/048,153, filed Sep. 9, 2014, the disclosures of which are incorporated by reference in their entireties herein.

FIELD OF THE INVENTION

Provided are devices and methods for noise reduction. More particularly, the provided articles and methods relate to reducing noise associated with a flow system.

BACKGROUND

Airborne sound energy associated with combustion engines, electric fan motors, fans, heating-ventilation-air conditioning (HVAC) systems, intake system, and the like, contributes to noise pollution and is generally undesirable. Noise can be a problem in any place occupied by people, such as within the home, work environment, vehicles, and even personal protective equipment such as respirators. Reducing airborne noise is an especially important in automotive markets. Minimum noise reduction standards for exhaust noise are the subject of numerous government regulations for passenger and commercial vehicles. Further, low cabin noise has long been valuable feature in passenger cars.

Elimination or reduction of sound energy at its source is preferred, but not always possible. In automobiles, for example, airborne sound energy derives from the rapid expansion of internal combustion engine chamber exhaust gases. As these combustion gases are exhausted, a sound wave front travels at sonic velocities through the exhaust system. Automotive noise can also come from cooling fans, alternators and other engine accessories. Accordingly, manufacturers have turned to acoustic technologies capable of substantially reducing the noise emitted by these devices.

The nature of the noise to be reduced is of considerable significance in developing an efficient exhaust or HVAC silencer. The airborne sound energy from a combustion engine or HVAC system typically comes of a plurality of sources, each emitting sound over its own characteristic frequencies. Conventionally, attenuation of a sound wave can be accomplished by causing the wave to encounter surfaces or structures that cause acoustic energy to be dissipated or diverted away from sensitive locations; these interactions turn the individual wave components of high amplitude into a plurality of waves of lesser amplitude, thus lowering the overall noise level. Such devices, to be efficient, may comprise a series of component devices that are individually tuned to alter the phase relationships of respective sound waves.

As described in the literature, perforated films can be used to attenuate sound energy in acoustic silencers. The devices described in these disclosures, however, are generally used for static flow and do not address the effect of such perforated films on the pressure drop associated with the device, as addressed below.

SUMMARY

Pressure drop is an often unappreciated problem in acoustic management. As used herein, this is the difference in air pressure measured between the inlet and outlet ends of an inline acoustic device. A high pressure drop is often the result of poor flow characteristics in the silencer, which can in turn lead to excessive heat and inefficient device performance. For example, in high performance vehicles, a high pressure drop in the exhaust system can lead to reduced horsepower and torque. Similarly, in an HVAC system, a high pressure drop forces the fans driving the air to work harder, resulting in high power expenditure. Aspects of the silencer that improve acoustic attenuation generally tend to increase pressure drop, and vice versa, so the technical solution has often been viewed as a tradeoff between these two considerations.

The provided acoustic devices address the dual problems of acoustic attenuation and pressure drop by incorporating one or more perforated films into the air flow field of an expansion chamber. Use of the perforated film enabled these devices to obtain significant sound attenuation by attenuating the pressure waves over a wide target frequency range spanning the human speech range of 250 Hz to 4000 Hz. Further, these devices facilitate air flow through the expansion chamber, thereby improving flow performance relative to those of conventional devices that do not include the perforated films.

In one aspect, an acoustic device is provided. The acoustic device has an inlet and an outlet comprising: an external housing defining an expansion chamber; and a tubular wall extending through and partitioning the expansion chamber into a central chamber and a peripheral chamber adjacent the central chamber, wherein both the inlet and outlet communicate with the central chamber, and wherein the tubular wall includes a plurality of apertures formed therethrough to allow air flow between the central and peripheral chambers, the plurality of apertures configured to provide an average flow resistance ranging from 100 MKS Rayls to 5000 MKS Rayls.

In another aspect, a method of attenuating airborne sound energy using an acoustic device with an external housing defining an expansion chamber, a tubular wall extending through and partitioning the expansion chamber into a central chamber and peripheral chamber adjacent the central chamber, and an inlet and outlet communicating with opposing ends of the central chamber, is provided, the method comprising: flowing air through the central chamber; and directing the sound energy from the central chamber through a plurality of apertures disposed in the tubular wall, wherein the plurality of apertures provide an average flow resistance ranging from 100 MKS Rayls to 5000 MKS Rayls.

DETAILED DESCRIPTION

As used herein, the terms "preferred" and "preferably" refer to embodiments described herein that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein and in the appended claims, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

It is noted that the term "comprises" and variations thereof do not have a limiting meaning where these terms appear in the accompanying description. Moreover, "a," "an," "the," "at least one," and "one or more" are used interchangeably herein.

Relative terms such as left, right, forward, rearward, top, bottom, side, upper, lower, horizontal, vertical, and the like may be used herein and, if so, are from the perspective observed in the particular figure. These terms are used only to simplify the description, however, and not to limit the scope of the invention in any way.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Drawings are not necessarily to scale.

Figure 1:
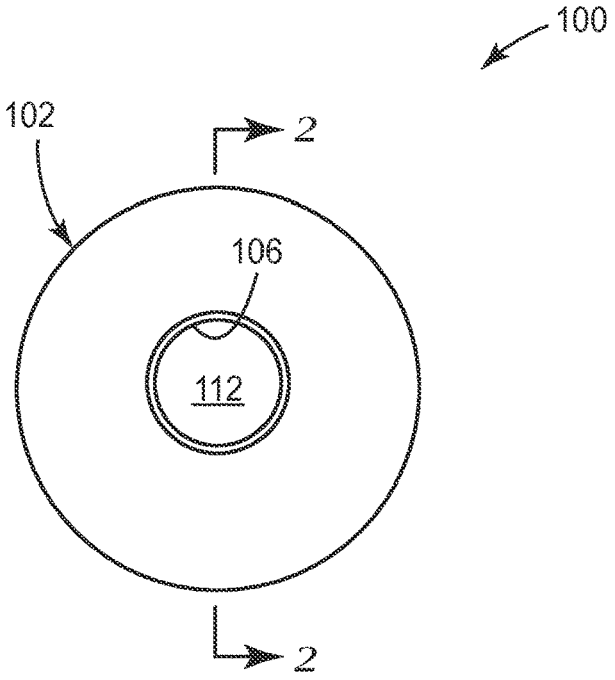
FIG. 1 is a front, elevational view of an acoustic device according to one exemplary embodiment.
Figure 2:
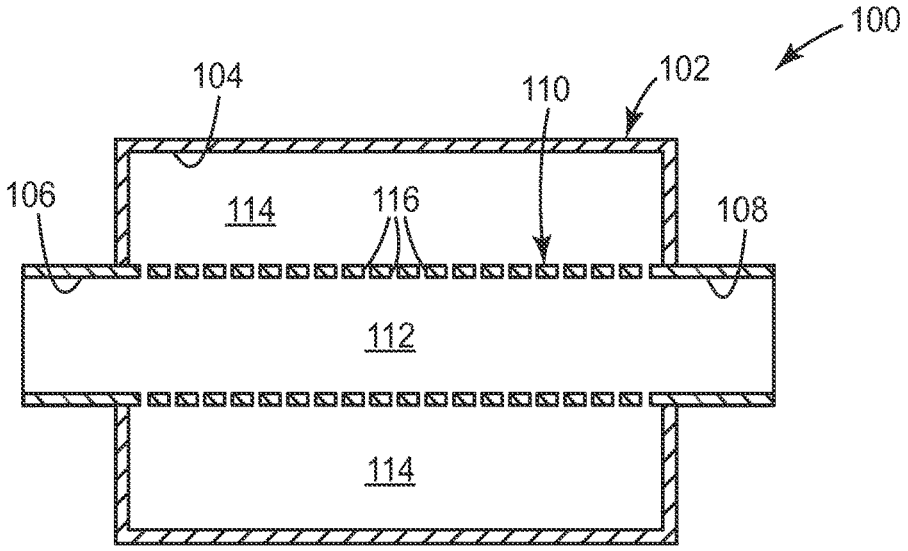
FIG. 2 is a side, cross-sectional view of the acoustic device of FIG. 1.

An exemplary acoustic device is illustrated in FIGS. 1 and 2 and herein designated by the numeral 100. The acoustic device 100 has an external housing 102 that is generally hollow and has rigid walls. Optionally, and as shown in FIG. 2, the external housing 102 is cylindrical. There are no particular restrictions on the shape of the external housing 102, however, and the shape need not have a uniform cross-section along its length. For example, it may assume any of a number of geometric shapes, including a cuboid, elliptical prism, or cone.

The external housing 102 may be provided as a single, unitary component or comprise two or more parts that are coupled together. If desired, the external housing 102 can be made by joining two halves or sections along an interface extending along the length of the acoustic device 100.

As further shown in FIGS. 1 and 2, the interior surfaces of the hollow external housing 102 define an expansion chamber 104. The expansion chamber 104 is connected to both an inlet 106 and an outlet 108, through which air can flow into and out of the acoustic device 100, respectively. There are no particular restrictions on the inlet 106 and outlet 108, which may have the same or different diameters.

The expansion chamber 104, by its nature, has a cross-sectional area significantly larger than the cross-sectional area of the inlet 106. As depicted, the cross-sectional area of the expansion chamber 104 is also larger than that of the outlet 108, which has a similar diameter as the inlet 106. In FIGS. 1-2, the expansion chamber 104 has a uniform cross-section, although expansion chambers in alternative configurations may have cross-section dimensions that deviate in size or shape from that illustrated here.

While the cross-sectional area of the expansion chamber 104 is larger than that of the inlet 106, there are no particular restrictions on the absolute dimensions of the expansion chamber 104. In some preferred embodiments, the expansion chamber 104 is a quarter-wave resonator.

A quarter-wave resonator is an enclosure in which a propagating sound wave can enter at one end and reflect off a rigid boundary at the opposite end in a manner that produces a standing wave. This occurs when the phases of reflected compressions and rarefactions at the inlet of the expansion chamber 104 coincide exactly with the vibration of the sound source, a condition referred to as resonance. At resonance, there is optimized scattering and/or absorption of the sound waves by the expansion chamber 104. Multiple expansion chambers that resonate at different frequencies can be connected in series to reduce noise over a broad frequency range.

The acoustic device 100 further includes a tubular wall 110 that has a cylindrical shape and extends along the longitudinal axis of the expansion chamber 104. As evident from the cross-sectional view of FIG. 1, the diameter of the tubular wall 110 essentially matches that of the inlet 106 and outlet 108. This is, however, not critical, and the cross-sectional areas of the inlet 106, outlet 108, and tubular wall 110 need not be identical.

Further, the inlet 106, outlet 108, and tubular wall 110 could either be aligned with or offset from the central, longitudinal axis of the expansion chamber 104.

The tubular wall 110 need not be cylindrical and other shapes such as a conical or square duct would also function acoustically.

The tubular wall 110 divides the expansion chamber 104 into two chambers that extend along the full length of the expansion chamber 104—a central chamber 112 and a peripheral chamber 114. The central chamber 112 is the cylindrical space bounded within the inner surface of the tubular wall 110. The distal ends of the central chamber 112 are longitudinally aligned with both the inlet 106 and outlet 108 such that the central chamber 112 freely communicates with each. As shown, the peripheral chamber 114 is the portion of the expansion chamber 104 located outside of the central chamber 112. In this embodiment, the peripheral chamber 114 assumes the shape of a cylindrical shell that is concentric with the central chamber 112.

While the tubular wall 110 extends across the overall length of the expansion chamber 104 here, it is also possible for the tubular wall 110 to extend along only a portion of the overall length of expansion chamber 104. In such cases, the central chamber 112 would be bounded by the terminal end of the tubular wall 110 within the external housing 102, with the peripheral chamber 114 occupying the balance of the expansion chamber 104. The spacing between the terminal end of the tubular wall 110 and the outlet end of the expansion chamber 104 can be advantageously tuned to attenuate preferentially sounds of particular frequencies.

This acoustic device 100 could also function if peripheral chamber 114 is subdivided in the axial direction to create cells, segments, or compartments adjacent to the tubular wall 110. Consequently, there need not be a continuously connected chamber adjacent to the tubular wall 110. The walls that represent the boundaries of such compartments can be either solid or perforated. In some embodiments, there are only partial walls between these compartments.

Depending on the sound frequency profile desired, the tubular wall 110 can extend along at least 50 percent, at least 60 percent, at least 70 percent, at least 80 percent, or at least 90 percent of the overall length of the expansion chamber 104. Moreover, the tubular wall 110 can extend along at most 99 percent, at most 95 percent, at most 80 percent, at most 70 percent, or at most 60 percent of the overall length of the expansion chamber 104.

The external housing 102 and the tubular wall 110 may be made of any structurally suitable material. In ambient temperature applications, including most HVAC applications, these components are advantageously made from polymeric materials, which can be lighter and cleaner than their metal counterparts. Preferred polymeric materials include thermoplastics and thermosets suitable for injection molding, extrusion, blow molding, rotomolding, reactive injection molding, and compression molding. Particularly suitable thermopolymers include, for example, ABS, nylon, polyethylene, polypropylene, and polystyrene. It is noted that the stiffness of the material selected can also affect the acoustic performance of the overall device, an aspect that shall be described later.

The thickness of the tubular wall 110 has a direct bearing on the length of the apertures disposed therein. In some embodiments, the tubular wall 110 has a thickness of at least 50 micrometers, at least 60 micrometers, at least 75 micrometers, at least 100 micrometers, or at least 150 micrometers. In some embodiments, the tubular wall 110 has a thickness of at most 625 micrometers, at most 600 micrometers, at most 575 micrometers, at most 550 micrometers, or at most 500 micrometers.

Referring now to FIG. 2, the tubular wall 110 is perforated along some or all of its length. As illustrated, the tubular wall 110 includes a plurality of apertures 116 (i.e. through-holes) that allow air to flow between the central chamber 114 and peripheral chamber 114. In this embodiment, the apertures 116 define approximately cylindrical plugs of air that are mass components within a resonant system. These mass components vibrate within the apertures 116 and dissipate sound energy as a result of friction between the plugs of air and the walls of the apertures 116. Some dissipation also occurs as a result of destructive interference at the entrance of the apertures 116 from sound reflected in the peripheral chamber 114.

In the acoustic device 100, the apertures 116 can be advantageously tuned by adjusting their arrangement (e.g. numbers and spacing) and dimensions (e.g. aperture diameter, shape and length), to obtain a desired acoustic performance over a given frequency range while minimizing the pressure drop between the inlet 106 and outlet 108. Acoustic performance is commonly measured, for example, by transmission loss through the acoustic device 100, which is defined here as the accumulated decrease in acoustic intensity as an acoustic pressure wave propagates from the inlet 106 to the outlet 108.

In the figures presented, the apertures 116 are disposed along the entire length of the tubular wall 110, the lengthwise dimension defined as the direction of air flow through the tubular wall 110. Optionally, the apertures 116 can be disposed along only some of this length. It is preferred that the apertures 116 are disposed along at least 15 percent, at least 20 percent, at least 30 percent, at least 40 percent, at least 50 percent, at least 60 percent, at least 70 percent, at least 80 percent, at least 85 percent, at least 90 percent, or at least 95 percent of the overall length of the tubular wall 110. Thus, the tubular wall 110 could be only partially perforated—that is, perforated in some areas but not others. For example, there could be unperforated sections in the vicinity of the inlet or outlet here. The perforated areas could also extend along longitudinal directions and be adjacent to one or more non-perforated areas—for example, the tubular wall could have a rectangular cross-section tube with only one or two sides perforated.

The apertures 116 can have a wide range of geometries and dimensions and may be produced by any of a variety of cutting or punching operations. The cross-section of the apertures 116 can be, for example, circular, square, or hexagonal. In some embodiments, the apertures 116 are represented by an array of elongated slits. While the apertures 116 in FIG. 2 have diameters that are uniform along their length, it is possible to use apertures that have the shape of a truncated cone or otherwise have side walls tapered along at least some their length. Various aperture configurations are described in U.S. Pat. No. 6,617,002 (Wood).

Optionally and as shown in the figure, the apertures 116 have a generally uniform spacing with respect to each other. If so, the apertures 116 may be arranged in a two-dimensional box pattern or staggered pattern. The apertures 116 could also be disposed on the tubular wall 110 in a randomized configuration where the exact spacing between neighboring apertures is non-uniform but the apertures 116 are nonetheless evenly distributed across the tubular wall 110 on a macroscopic scale.

In some embodiments, the apertures 116 are of essentially uniform diameter along the tubular wall 110. Alternatively, the apertures 116 could have some distribution of diameters. Either way, in preferred embodiments of the acoustic device 100, the average narrowest diameter of the apertures 116 is at least 10 micrometers, at least 15 micrometers, at least 20 micrometers, at least 25 micrometers, or at least 30 micrometers. Further, the average narrowest diameter of the apertures 116 is preferably at most 300 micrometers, at most 250 micrometers, at most 200 micrometers, at most 175 micrometers, or at most 150 micrometers. For the sake of clarity, the diameter of non-circular holes is defined herein as the diameter of a circle having the equivalent area as the non-circular hole in plan view.

By its nature, the perforated tubular wall 110 has a specific acoustic impedance, which is the ratio (in frequency space) of the pressure differences across the tubular wall and the effective velocity approaching that surface. In the theoretical model of rigid walls with apertures, the velocity derives from air moving into and out of the holes. Where the wall is not rigid but flexible, motion of the wall can contribute to the calculation. Specific acoustic impedance generally varies as a function of frequency and is a complex number, which reflects the fact that pressure and velocity waves can be out of phase.

As used herein, specific acoustic impedance is measured in MKS Rayls, in which 1 Rayl is equal to 1 pascal-second per meter ($Pa \cdot s \cdot m^{-1}$), or equivalently, 1 newton-second per cubic meter ($N \cdot s \cdot m^{-1}$), or alternatively, 1 $kg \cdot s^{-1} \cdot m^{-2}$. The plurality of apertures 116 in the acoustic device 100 are preferably sized to achieve significant acoustic attenuation over the speech frequency range extending approximately from 250 Hz to 4000 Hz.

The perforated tubular wall 110 of the acoustic device 100 can be characterized by measuring its transfer impedance. For a relatively thin film, transfer impedance is the difference between the acoustic impedance on the incident side of the film and the acoustic impedance one would observe if the film were not present—that is, the acoustic impedance of the air cavity alone. In particular embodiments, the apertures 116 are sized to provide an acoustic transfer impedance having a real component of at least 100 Rayls, at least 200 Rayls, at least 250 Rayls, at least 300 Rayls, at least 325 Rayls, or at least 350 Rayls. Moreover, the plurality of apertures 116 can be sized to provide an acoustic transfer impedance having a real component of at most 5000 Rayls, at most 4000 Rayls, at most 3000 Rayls, at most 2000 Rayls, at most 1500 Rayls, at most 1400 Rayls, at most 1250 Rayls, at most 1100 Rayls, or at most 1000 Rayls (all in MKS Rayls).

The flow resistance is the low frequency limit of the transfer impedance. Experimentally, this can be estimated by blowing a known, small velocity of air at the perforated tubular wall 110 and measuring the pressure drop associated therewith. The flow resistance can be determined as the measured pressure drop divided by the velocity. For some embodiments, the flow resistance through the tubular wall 110 is at least 50 Rayl, at least 100 Rayl, at least 250 Rayl, at least 500 Rayl, or at least 1000 Rayl. Moreover, the flow resistance can be at most 5000 Rayl, at most 3000 Rayl, at most 2000 Rayl, at most 1500 Rayl, at most 1000 Rayl, or at most 800 Rayl (all in MKS Rayls).

The porosity of the tubular wall 110 is a dimensionless quantity representing the fraction of a given volume not occupied by solid structure. In the simplified representation shown in FIGS. 1-2, the apertures 116 can be assumed to be cylindrical, in which case porosity is well approximated by the percentage of the surface area of the tubular wall 110 displaced by the apertures 116 in plan view. In exemplary embodiments, the tubular wall 110 has a porosity of at least 0.3 percent, at least 0.5 percent, at least 1 percent, at least 3 percent, or at least 4 percent. On the upper end, the tubular wall 110 could have a porosity of at most 5 percent, at most 4 percent, at most 3.5 percent, at most 3 percent, or at most 2 percent.

The tubular wall 110 is preferably made from a material having a modulus suitably tuned to vibrate in response to incident sound waves of relevant frequencies. Along with the vibrations of the air plugs within the apertures 116, local vibrations of the tubular wall 110 itself can dissipate sound energy and enhance transmission loss through the acoustic device 100. The modulus, or stiffness, of the tubular wall 110 also directly affects its acoustic transfer impedance.

In some embodiments, the tubular wall comprises a material having a modulus of at least 0.2 gigapascals, and/or a modulus of at most 10 gigapascals, at most 7 gigapascals, at most 5 gigapascals, or at most 4 gigapascals.

Advantageously, the provided acoustic device 100 enables a sound pressure wave arriving from the inlet 106 to expand into the expansion chamber 104 without significantly interrupting mass flow through the central chamber 112. Expressed differently, the acoustic device 100 decouples the technical challenge of moving air through the acoustic device 100 and allowing the pressure waves to dissipate.

In general terms, the sound absorption characteristics that can be ascribed to a plurality of apertures disposed in a flexible film are described in, for example, U.S. Pat. No. 6,617,002 (Wood), U.S. Pat. No. 6,977,109 (Wood), and U.S. Pat. No. 7,731,878 (Wood).

Based on the above features, a primary advantage of the provided acoustic device 100 is its ability to reduce airborne noise while minimizing the pressure drop through the device. This effect can be measured, for example, with respect to a control acoustic device having an expansion chamber 102 devoid of the perforated tubular wall 110. In some embodiments, disposing the plurality of apertures 116 on the tubular wall 110 reduces pressure drop at a benchmark flow rate of 170 liters per minute by least 20 percent, at least 35 percent, at least 50 percent, at least 60 percent, or at least 70 percent, relative to the pressure drop associated with the expansion chamber 104 alone (i.e., with the tubular wall 110 removed).

Figure 3:
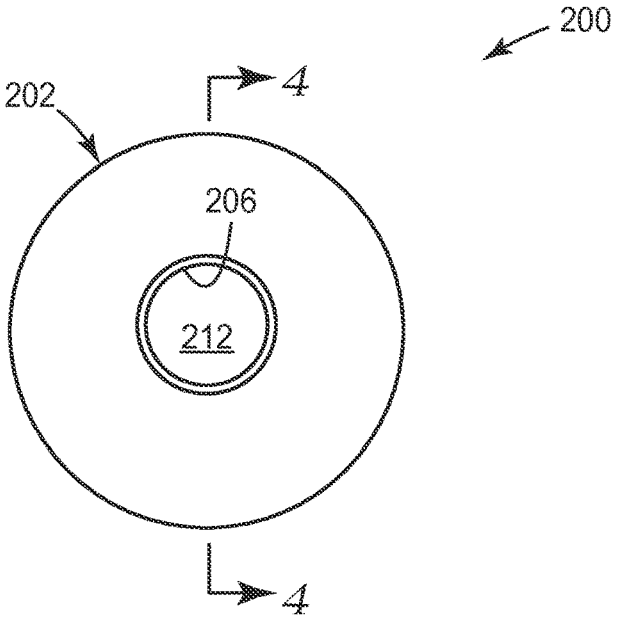
FIG. 3 is a front, elevational view of an acoustic device according to another exemplary embodiment.

FIG. 3 shows an acoustic device 200 having an inlet 206 and outlet 208 according to another exemplary embodiment that bears similarity to the acoustic device 100 in most respects but further includes a second peripheral chamber 218. In this configuration, a central chamber 212, a first peripheral chamber 214, and the second peripheral chamber 218 are bounded by progressively larger concentric, cylindrical outer surfaces. Like its equivalent structures in the acoustic device 100, the central chamber 212 is defined by a first tubular wall 210 perforated by a plurality of apertures 216 and is geometrically aligned with the inlet 206 and outlet 208.

As depicted, the second peripheral chamber 218 is a cylindrical shell adjacent the first peripheral chamber 214. Disposed between the first and second peripheral chambers 214, 218 is a second tubular wall 220 that defines the outer boundary of the first peripheral chamber 214 and the inner boundary of the second peripheral chamber 218. Like the first tubular wall 210, the second tubular wall 220 is perforated by a plurality of second apertures 222. The second apertures 222, which allow limited communication between the first and second peripheral chambers 214, 218, operate to dissipate sound energy in a manner like that of the first apertures 216.

The second apertures 222, however, may or may not be tuned to the same acoustic properties as the apertures 216. In one instance, the apertures 222 have the same or similar acoustic transfer impedance, flow resistance, and/or porosity as the apertures 216. Alternatively, the apertures 222 can have an acoustic transfer impedance significantly higher or lower than that of the apertures 216, depending on the noise source.

In some embodiments, the apertures 222 can have an acoustic transfer impedance that is lower than that of the apertures 216 by 50 Rayls, by 100 Rayls, by 150 Rayls, by 200 Rayls, by 300 Rayls, by 400 Rayls, or by 500 Rayls. Conversely, the apertures 222 can have an acoustic transfer impedance that is greater than that of the apertures 216 by 50 Rayls, by 100 Rayls, by 150 Rayls, by 200 Rayls, by 300 Rayls, by 400 Rayls, or by 500 Rayls (all in MKS Rayls).

While the attenuation of sound provided by the acoustic device 200 was enhanced relative to that of the acoustic device 100, the addition of the second tubular wall 220 and second peripheral chamber 218 was not found to significantly increase pressure drop across the expansion chamber. This is a major technical benefit, because the apertures 222 can be specifically tuned to dissipate particular sound frequencies without a significant increase in pressure drop.

Remaining aspects of the acoustic device 200 are analogous to those of acoustic device 100 as already shown in FIGS. 1 and 2 and are not examined here.

It is contemplated that additional peripheral chambers may be included in the provided acoustic devices having structural features analogous to the peripheral chambers 114, 214, 218 described herein.

Figure 5A:
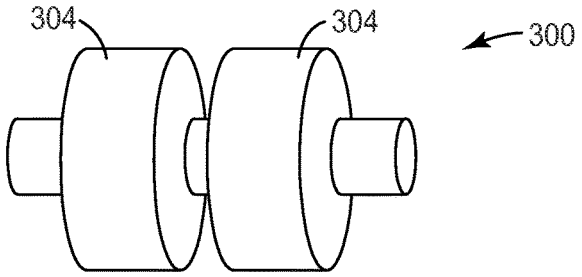
FIGS. 5A-5D are perspective views of further exemplary configurations of an acoustic device.
Figure 5B:
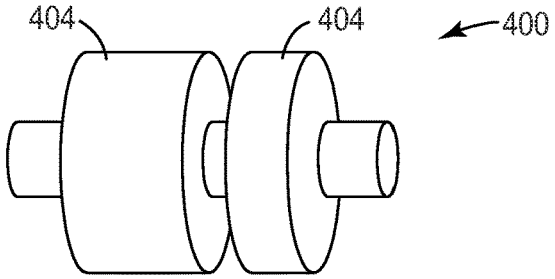
Figure 5C:
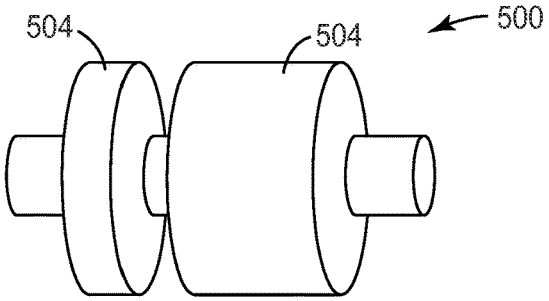
Figure 5D:
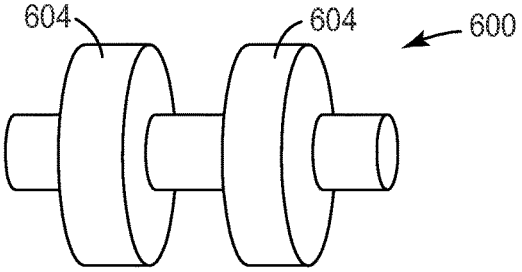

A series of dual-chamber acoustic devices are shown in FIGS. 5A-5D. In each of the alternative configurations shown, an additional expansion chamber has been incorporated into the acoustic device. FIG. 5A shows an acoustic device 300 that has the same overall length as the acoustic devices 100,200, but includes a pair of expansion chambers 304, 304, each being less than half the length of the expansion chamber 104, 204. FIGS. 5B and 5C show acoustic devices 400, 500 having respective expansion chambers 404, 504 that are asymmetric. In the acoustic device 400, the expansion chamber 404 adjacent the inlet is longer; in the acoustic device 500, the expansion chamber 504 adjacent the outlet is longer. FIG. 5D shows an acoustic device 600 having expansion chambers 604 that have the same size but are shorter and separated from each other by a greater distance. Each of these devices is tuned to attenuate noise over a different acoustic frequency range.

Although not exemplified here, additional expansion chambers may be added (a third, fourth, etc.) to further attenuate sound energy over specific frequency ranges. Further, the separation between adjacent chambers may be reduced to zero, in which case the peripheral chamber is simply segmented into a number of annular segments along its length.

While not intended to be limiting, further exemplary embodiments are described as follows:

1. An acoustic device having an inlet and an outlet comprising: an external housing defining an expansion chamber; and a tubular wall extending through and partitioning the expansion chamber into a central chamber and a peripheral chamber adjacent the central chamber, wherein both the inlet and outlet communicate with the central chamber, and wherein the tubular wall includes a plurality of apertures formed therethrough to allow air flow between the central and peripheral chambers, the plurality of apertures configured to provide an average flow resistance ranging from 100 MKS Rayls to 5000 MKS Rayls.

2. The acoustic device of embodiment 1, wherein the plurality of apertures are configured to provide an average flow resistance ranging from 250 MKS Rayls to 3000 MKS Rayls.

3. The acoustic device of embodiment 2, wherein the plurality of apertures are configured to provide an average flow resistance ranging from 500 MKS Rayls to 2000 MKS Rayls.

4. The acoustic device of any one of embodiments 1-3, wherein the apertures have an average narrowest diameter ranging from 10 micrometers to 250 micrometers.

5. The acoustic device of embodiment 4, wherein the apertures have an average narrowest diameter ranging from 20 micrometers to 200 micrometers.

6. The acoustic device of embodiment 5, wherein the apertures have an average narrowest diameter ranging from 30 micrometers to 150 micrometers.

7. The acoustic device of any one of embodiments 1-6, wherein the tubular wall has a thickness ranging from 50 micrometers to 625 micrometers.

8. The acoustic device of embodiment 7, wherein the tubular wall has a thickness ranging from 75 micrometers to 575 micrometers.

9. The acoustic device of embodiment 8, wherein the tubular wall has a thickness ranging from 150 micrometers to 500 micrometers.

10. The acoustic device of any one of embodiments 1-9, wherein the tubular wall has a porosity ranging from 0.3 percent to 5 percent.

11. The acoustic device of embodiment 10, wherein the tubular wall has a porosity ranging from 0.3 percent to 3.5 percent.

12. The acoustic device of embodiment 11, wherein the tubular wall has a porosity ranging from 0.3 percent to 2 percent.

13. The acoustic device of any one of embodiments 1-12, wherein the tubular wall comprises a material having a modulus ranging from 0.2 GPa to 10 GPa.

14. The acoustic device of embodiment 13, wherein the tubular wall comprises a material having a modulus ranging from 0.2 GPa to 5 GPa.

15. The acoustic device of embodiment 14, wherein the tubular wall comprises a material having a modulus ranging from 0.2 GPa to 4 GPa.

16. The acoustic device of any one of embodiments 1-15, wherein the peripheral chamber and central chamber are concentric.

17. The acoustic device of any one of embodiments 1-16, wherein the tubular wall reduces pressure drop from the inlet to the outlet at a flow rate of 170 liters per minute by least 20 percent relative to the pressure drop associated with the expansion chamber alone.

18. The acoustic device of embodiment 17, wherein the tubular wall reduces pressure drop by least 50 percent relative to the pressure drop associated with the expansion chamber alone.

19. The acoustic device of embodiment 18, wherein the tubular wall reduces pressure drop by least 70 percent relative to the pressure drop associated with the expansion chamber alone.

20. The acoustic device of any one of embodiments 1-19, wherein the inlet and the outlet have cross-sectional diameters that generally match the cross-sectional diameter of the tubular wall.

21. The acoustic device of any one of embodiments 1-20, wherein the tubular wall extends along the entire length of the expansion chamber.

22. The acoustic device of any one of embodiments 1-21, wherein the tubular wall extends along 50 percent to 99 percent of the overall length of the expansion chamber.

23. The acoustic device of embodiment 22, wherein the tubular wall extends along 60 percent to 95 percent of the overall length of the expansion chamber.

24. The acoustic device of embodiment 23, wherein the tubular wall extends along 70 percent to 80 percent of the overall length of the expansion chamber.

25. The acoustic device of any one of embodiments 1-24, wherein the tubular wall is a first tubular wall, the apertures are first apertures, and the peripheral chamber is a first peripheral chamber and further comprising: a second tubular wall defining a second peripheral chamber adjacent the first peripheral chamber, wherein the second tubular wall has a plurality of second apertures sized to provide an acoustic transfer impedance significantly lower than that of the plurality of first apertures.

26. The acoustic device of embodiment 25, wherein the plurality of second apertures are sized to provide an average flow resistance ranging from 100 MKS Rayls to 5000 MKS Rayls.

27. The acoustic device of embodiment 26, wherein the plurality of second apertures are sized to provide an average flow resistance ranging from 250 MKS Rayls to 3000 MKS Rayls.

28. The acoustic device of embodiment 27, wherein the plurality of second apertures are sized to provide an average flow resistance ranging from 500 MKS Rayls to 2000 MKS Rayls.

29. The acoustic device of any one of embodiments 1-28, wherein the expansion chamber is a first expansion chamber, and the external housing further comprises a second expansion chamber having all the limitations of the first expansion chamber, wherein the outlet of the first expansion chamber communicates with the inlet of the second expansion chamber.

30. A method of attenuating airborne sound energy using an acoustic device with an external housing defining an expansion chamber, a tubular wall extending through and partitioning the expansion chamber into a central chamber and peripheral chamber adjacent the central chamber, and an inlet and outlet communicating with opposing ends of the central chamber, the method comprising:

flowing air through the central chamber; and directing the sound energy from the central chamber through a plurality of apertures disposed in the tubular wall, wherein the plurality of apertures provide an average flow resistance ranging from 100 MKS Rayls to 5000 MKS Rayls.

31. The method of embodiment 30, wherein the tubular wall reduces pressure drop from the inlet to the outlet at a flow rate of 170 liters per minute by least 20 percent relative to the pressure drop associated with the expansion chamber alone.

32. The method of embodiment 31, wherein the tubular wall reduces pressure drop from the inlet to the outlet at a flow rate of 170 liters per minute by least 50 percent relative to the pressure drop associated with the expansion chamber alone.

33. The method of embodiment 32, wherein the tubular wall reduces pressure drop from the inlet to the outlet at a flow rate of 170 liters per minute by least 70 percent relative to the pressure drop associated with the expansion chamber alone.

34. The method of any one of embodiments 30-33, wherein the wall is a first wall, the apertures are first apertures, and the peripheral chamber is a first peripheral chamber and further comprising: directing the sound energy from the first peripheral chamber through a plurality of second apertures disposed in a second wall bounding the first peripheral chamber into a second peripheral chamber adjacent the first peripheral chamber to provide a transfer impedance for the second wall that is significantly lower than that of the first wall.

35. The method of embodiment 34, wherein the second wall provides an average flow resistance ranging from 100 MKS Rayls to 5000 MKS Rayls.

36. The method of embodiment 35, wherein the second wall provides an average flow resistance ranging from 250 MKS Rayls to 3000 MKS Rayls.

37. The method of embodiment 36, wherein the second wall provides an average flow resistance ranging from 500 MKS Rayls to 2000 MKS Rayls.

EXAMPLES

Test Methods

Acoustic Testing

The acoustic properties of a microperforated film or panel can be measured by following the procedures outlined in ASTM E2611-09 (Standard Test Method for Measurement of Normal Incidence Sound Transmission of Acoustical Materials Based on the Transfer Matrix Method). The data collected from this procedure can be used to obtain the acoustic transmission loss.

This data can also be used to obtain the transfer impedance of the film. One of the outputs of this procedure is a 2×2 transfer matrix that relates the pressure and acoustic particle velocity on the two sides of the microperforated film. By following the procedure outlined below, the elements of the transfer matrix can then be used to calculate the transfer impedance of the film.

The relationships between pressure and velocity on the front and rear surfaces of the film can be described using the transfer matrix: i.e., $$\begin{bmatrix} p_1 \\ v_1 \end{bmatrix} = \begin{bmatrix} T_{11} & T_{12} \\ T_{21} & T_{22} \end{bmatrix} \begin{bmatrix} p_2 \\ v_2 \end{bmatrix} \tag{1}$$

To calculate the transfer impedance, first assume that the front velocity $v_1$ and the rear velocity $v_2$ are the same (based on the assumption that the flow through the film is incompressible); then the transfer impedance of the film can be described as follows:

$$z_t = \frac{p_1 - p_2}{v_1} = \frac{p_1 - p_2}{v_2} \tag{2}$$

From Equation (1), $p_1$ and $v_1$ can be written in following forms:

$$p_1 = T_{11}p_2 + T_{12}v_2 \tag{3}$$

$$v_1 = T_{21}p_2 + T_{22}v_2 \tag{4}$$

Then it is possible to manipulate Equations (3) and (4) to obtain the following results:

$$p_1 - p_2 = (T_{11} - 1)p_2 + T_{12}v_2 \tag{5}$$

$$T_{21}p_2 = (1 - T_{22})v_1$$

$$p_2 = \frac{(1 - T_{22})}{T_{21}}v_1 \tag{6}$$

After substituting Equation (6) into Equation (5) one obtains, $$p_1 - p_2 = \frac{(T_{11} - 1)(1 - T_{22})}{T_{21}}v_1 + T_{21}v_1 \tag{7}$$

Then, the transfer impedance can be obtained by substituting Equation (7) into Equation (2): i.e., $$\begin{aligned} z_t = \frac{p_1 - p_2}{v_1} &= \frac{(T_{11} - 1)(1 - T_{22})}{T_{21}} + T_{12} \\ &= \frac{(T_{11} - 1)(1 - T_{22}) + T_{12}T_{21}}{T_{21}} \\ &= \frac{T_{11} - T_{11}T_{22} + T_{22} + T_{12}T_{21} - 1}{T_{21}} \end{aligned} \tag{8}$$

Pressure Drop Testing

To provide a baseline for the pressure drop measurements, a separate acoustic device was assembled without any perforated film and without a housing to form a chamber. Only one end cap was used, and this measurement served as a baseline air flow measurement without any chambers or film. This baseline measurement was then subtracted from each measurement shown in FIG. 8, so that the pressure drop curves shown represent the pressure drop increase relative to the baseline.

For the pressure drop test, flow was generated by use of a compressed air controlled and throttled through a NORGREN regulator, Model No. 11-018-146 with a 10 psig maximum outlet. The regulator was adjusted to vary the flowrate. Flow rate was measured in line via a TSI flow gage, Model 4040. From there, air flow was directed through a straight tube with a side tap for in-line pressure measurement using a TSI VELOCICALC, Model 8386A pressure transducer.

Figure 6:
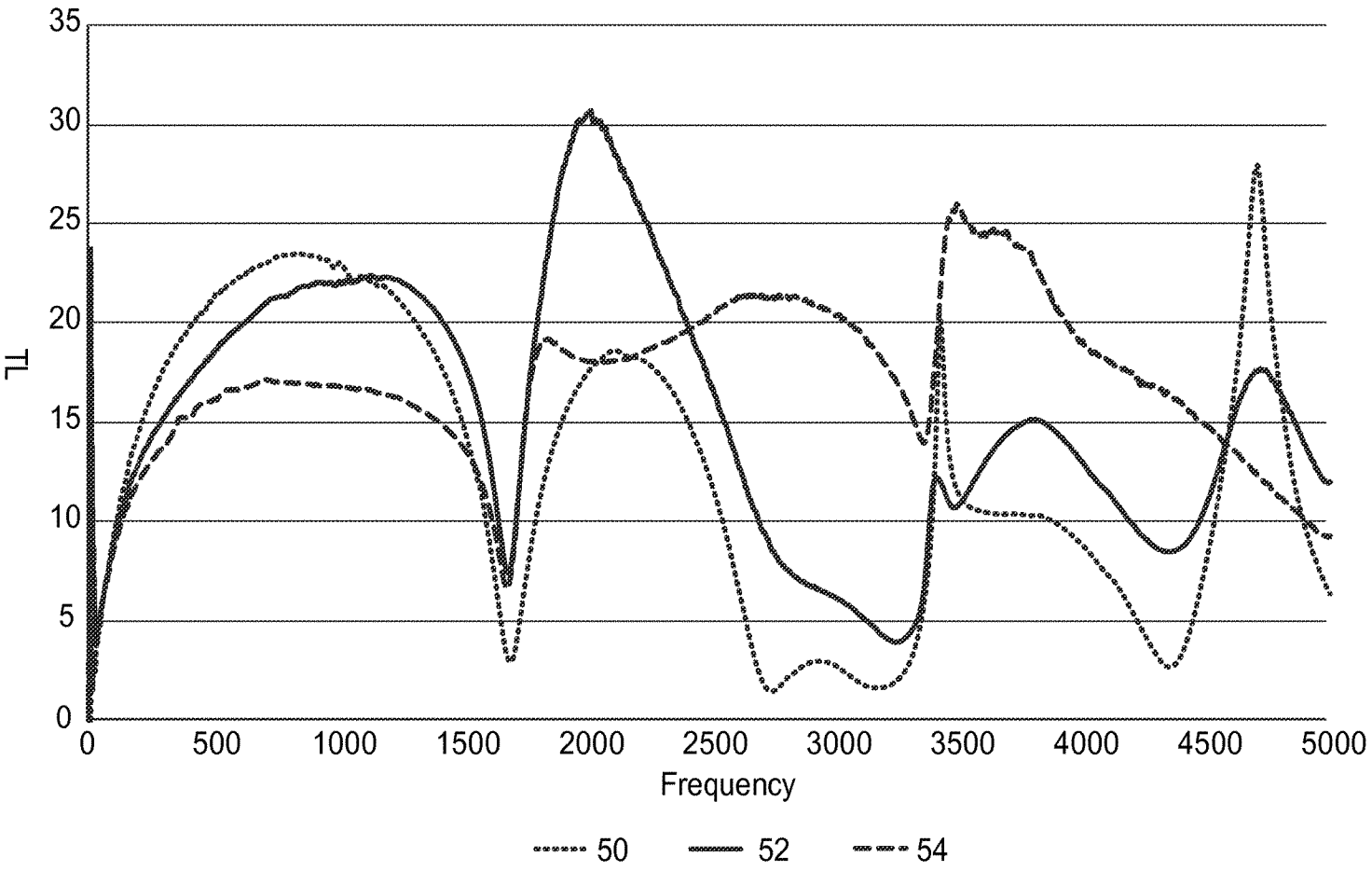
FIG. 6 is a spectrum plot of transmission loss (in decibels) versus frequency (in Hertz) for various acoustic devices having a single expansion chamber.
Figure 8:
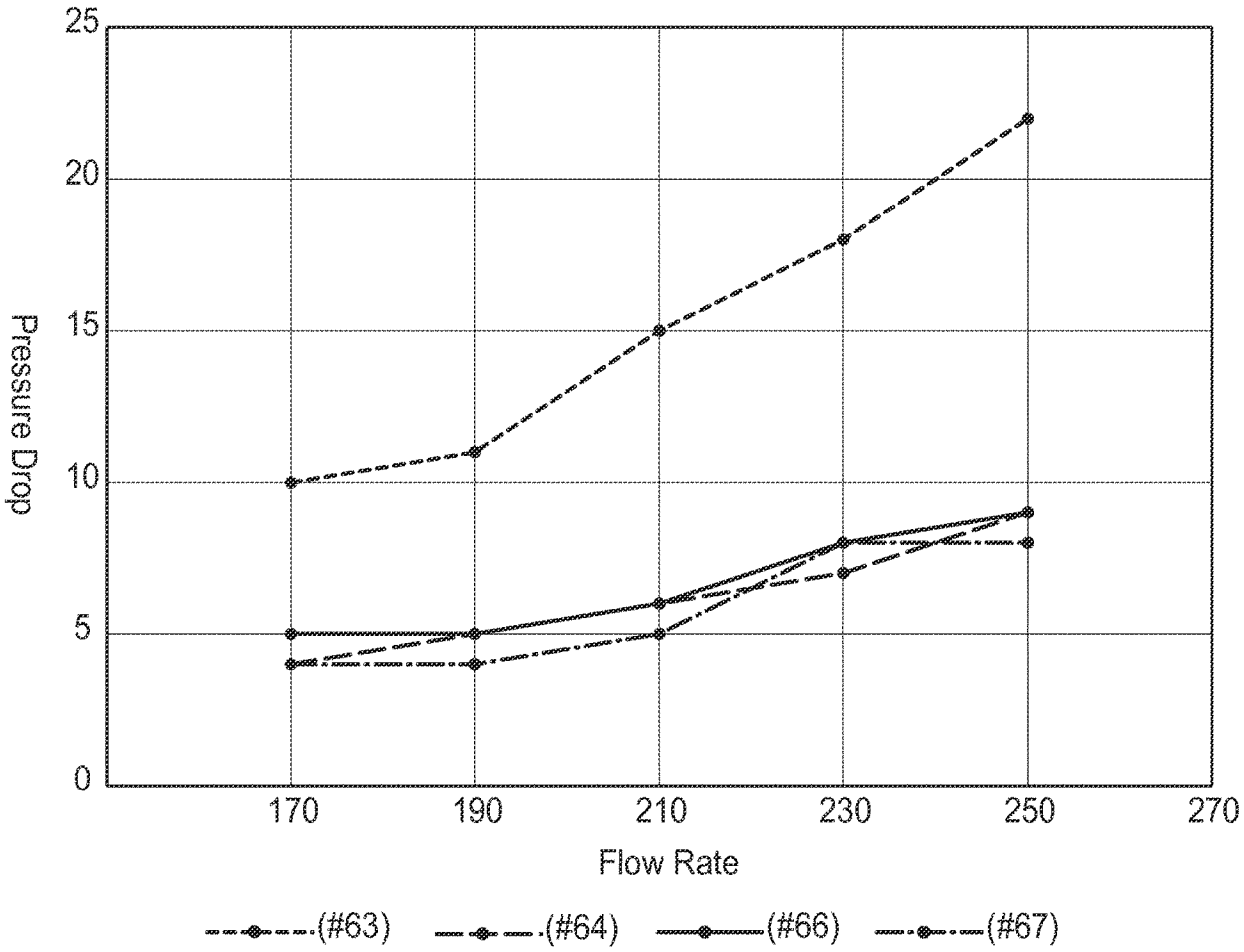
FIG. 8 is a plot comparing air pressure drop (pascals) versus flow rate (liters per minute) for various acoustic devices having a single expansion chamber.

Example 1 (FIG. 6: 52, FIG. 8: 64)

An acoustic device schematically shown in FIGS. 1 and 2 was assembled using the following procedure and materials. A cylindrical external housing defining a chamber was prepared via rapid prototyping (Fortes 400 model 3D printer, Stratasys Ltd., Eden Prairie, Minn.) using black acrylonitrile-butadiene-styrene (ABS) resin (Stratasys Ltd., Eden Prairie, Minn.). The length of the chamber was 9.6 cm. The inner diameter and outer diameter of the housing were 2.9 cm and 15.2 cm, respectively. End caps for the chamber were also prepared separately using rapid prototyping and black ABS resin. The end caps contained a 2.9 cm diameter annulus through which system air can flow through the acoustic device. Annular grooves were incorporated into the design of the end caps to contain tubes of perforated film.

A perforated film was prepared as described in U.S. Pat. No. 6,617,002 (Wood). A film-grade polypropylene resin was used to extrude the film. The film was perforated after extrusion by embossing the film and then heat treating the embossments to create apertures. The resulting film had a thickness of 0.35 mm, a basis weight of approximately 400 grams/meter$^2$ and an aperture/perforation density of 111 apertures/cm$^2$ with each individual aperture being roughly circular in shape with a diameter of approximately 0.094 mm. Flow resistance was determined to be approximately 450 MKS Rayls.

An open ended tube was prepared from the perforated film, the tube having a length of 9.7 cm and a diameter of 2.9 cm. The tube was then inserted into the housing and the annular grooves within the end cap forming a central chamber 112 and a peripheral chamber 114.

Acoustic and pressure drop data on this device are given in FIGS. 6 and 8, respectively, as indicated.

Comparative Example C1 (FIG. 6: 50; FIG. 8: 63)

An acoustic device was assembled as in Example 1 above without any perforated film, representing a simple expansion chamber.

Acoustic and pressure drop data on this device are given in FIGS. 6 and 8, respectively, as indicated.

Example 2 (FIG. 8: 66)

An acoustic device was assembled as in Example 1 above. The resulting film had a thickness of 0.35 mm, a basis weight of approximately 400 grams/meter$^2$ and an aperture density of 46 apertures/cm$^2$, the average aperture diameter being approximately 0.077 mm. The effective aperture diameter was decreased as compared to Example 1 to produce a film with a static air flow resistance of approximately 1750 MKS Rayls.

Pressure drop data on this device are provided in FIG. 8, as indicated.

Example 3 (FIG. 6: 54)

Figure 4:
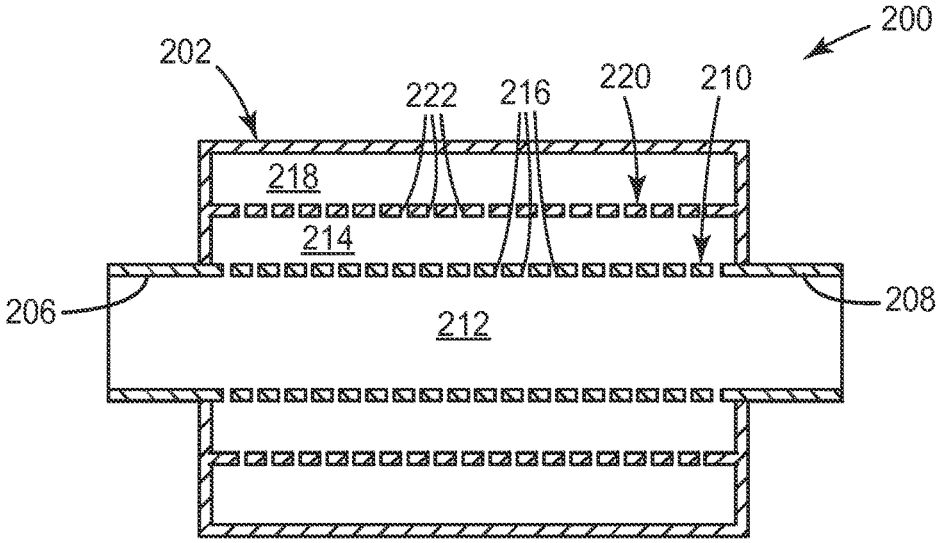
FIG. 4 is a side, cross-sectional view of the acoustic device of FIG. 3.

An acoustic device was assembled as in Example 1 above except two separate tubes of different diameters were created from the perforated film to provide the configuration shown in FIG. 4. The tubes were inserted into the housing and the annular grooves within the end cap forming the central chamber 212 and first and second peripheral chambers 214, 218. The two concentric tubes were spaced approximately 2.8 cm apart from each other along radial directions.

Acoustic data on this device are provided in FIG. 6, as indicated.

Figure 7:
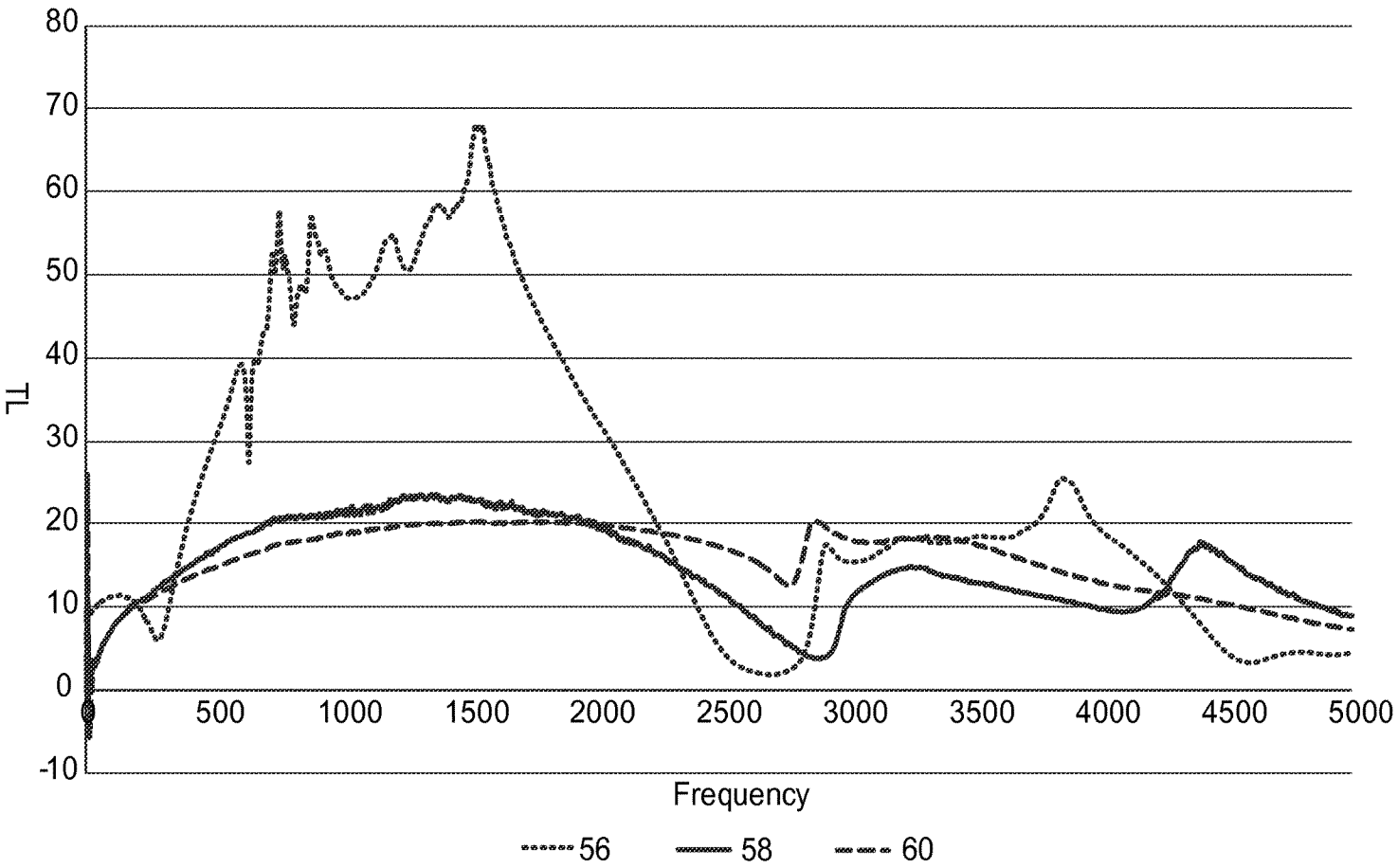
FIG. 7 is a spectrum plot of transmission loss (in decibels) versus frequency (in Hertz) for various acoustic devices having a dual expansion chamber.

Example 4 (FIG. 7: 58)

An acoustic device was assembled as in Example 1 above except two separate chambers in series were used, shown schematically in FIG. 5C (with air flowing from left to right). The two chambers were in fluid communication with each other, and spaced apart by a gap of approximately 2 cm.

Acoustic data on this device are provided in FIG. 7, as indicated.

Comparative Example C2 (FIG. 7: 56)

An acoustic device was assembled as in Example 4 above except without any perforated film.

Acoustic data on this device are provided in FIG. 7, as indicated.

Example 5 (FIG. 7: 60)

An acoustic device was assembled as in Example 3 above except two separate chambers in in series were used as shown in Example 4. The two chambers were spaced apart from each other by a gap of approximately 2 cm.

As in Example 3, each chamber contained a pair of concentric tubes with different diameters created from the perforated film, with the larger of the concentric tubes spaced approximately 2.8 cm apart from the smaller one along radial directions.

Acoustic data on this device are provided in FIG. 7, as indicated.

Comparative Example C3 (FIG. 8: 67)

An acoustic device was assembled as in Example 1, except a solid, non-perforated film was substituted for the perforated film.

Pressure drop data on this device are provided in FIG. 8, as indicated.

All patents and patent applications mentioned above are hereby expressly incorporated by reference. Although the invention herein has been described with reference to particular embodiments, it is to be understood that these embodiments are merely illustrative of the principles and applications of the present invention. It will be apparent to those skilled in the art that various modifications and variations can be made to the method and apparatus of the present invention without departing from the spirit and scope of the invention. Thus, it is intended that the present invention include modifications and variations within the scope of the appended claims and equivalents thereof.

What is claimed is:

1. An acoustic device suitable for ambient temperature applications having an inlet and an outlet comprising:

an external housing defining an expansion chamber; and a tubular wall extending through and partitioning the expansion chamber into a central chamber and a peripheral chamber adjacent the central chamber, wherein both the inlet and outlet communicate with the central chamber, and wherein the tubular wall has a thickness ranging from 50 micrometers to 625 micrometers and comprises a thermoplastic material having a modulus ranging from 0.2 GPa to 10 GPa and includes a plurality of apertures formed therethrough to allow air flow between the central and peripheral chambers, the plurality of apertures configured to provide an average flow resistance ranging from 100 MKS Rayls to 5000 MKS Rayls.

2. The acoustic device of claim 1, wherein the plurality of apertures are configured to provide an average flow resistance ranging from 250 MKS Rayls to 3000 MKS Rayls.

3. The acoustic device of claim 2, wherein the plurality of apertures are configured to provide an average flow resistance ranging from 500 MKS Rayls to 2000 MKS Rayls.

4. The acoustic device of claim 1, wherein the tubular wall has a porosity ranging from 0.3 percent to 5 percent.

5. The acoustic device of claim 1, wherein the tubular wall reduces pressure drop from the inlet to the outlet at a flow rate of 170 liters per minute by least 20 percent relative to the pressure drop associated with the expansion chamber alone.

6. The acoustic device of claim 5, wherein the tubular wall reduces pressure drop by least 50 percent relative to the pressure drop associated with the expansion chamber alone.

7. The acoustic device of claim 1, wherein the inlet and the outlet have cross-sectional diameters that generally match the cross-sectional diameter of the tubular wall.

8. The acoustic device of claim 1, wherein the tubular wall extends along the entire length of the expansion chamber.

9. The acoustic device of claim 1, wherein the tubular wall is a first tubular wall, the apertures are first apertures, and the peripheral chamber is a first peripheral chamber and further comprising:

a second tubular wall defining a second peripheral chamber adjacent the first peripheral chamber, wherein the second tubular wall has a plurality of second apertures sized to provide an acoustic transfer impedance significantly lower than that of the plurality of first apertures.

10. The acoustic device of claim 9, wherein the plurality of second apertures are sized to provide an average flow resistance ranging from 100 MKS Rayls to 5000 MKS Rayls.

11. The acoustic device of claim 10, wherein the plurality of second apertures are sized to provide an average flow resistance ranging from 250 MKS Rayls to 3000 MKS Rayls.

12. The acoustic device of claim 11, wherein the plurality of second apertures are sized to provide an average flow resistance ranging from 500 MKS Rayls to 2000 MKS Rayls.

13. The acoustic device of claim 1, wherein the expansion chamber is a first expansion chamber, and the external housing further comprises a second expansion chamber having all the limitations of the first expansion chamber, wherein the outlet of the first expansion chamber communicates with the inlet of the second expansion chamber.

14. A method of attenuating airborne sound energy using an acoustic device suitable for ambient temperature applications with an external housing defining an expansion chamber, a tubular wall having a thickness ranging from 50 micrometers to 625 micrometers and comprising a thermoplastic material having a modulus ranging from 0.2 GPa to 10 GPa and extending through and partitioning the expansion chamber into a central chamber and peripheral chamber adjacent the central chamber, and an inlet and outlet communicating with opposing ends of the central chamber, the method comprising:

flowing air through the central chamber; and directing the sound energy from the central chamber through a plurality of apertures disposed in the tubular wall, wherein the plurality of apertures provide an average flow resistance ranging from 100 MKS Rayls to 5000 MKS Rayls.

15. The method of claim 14, wherein the tubular wall reduces pressure drop from the inlet to the outlet at a flow rate of 170 liters per minute by least 20 percent relative to the pressure drop associated with the expansion chamber alone.

16. The method of claim 14, wherein the tubular wall extends along the entire length of the expansion chamber.

17. The method of claim 14, wherein the tubular wall is a first tubular wall, the apertures are first apertures, and the peripheral chamber is a first peripheral chamber and further comprising:

a second tubular wall defining a second peripheral chamber adjacent the first peripheral chamber, wherein the second tubular wall has a plurality of second apertures sized to provide an acoustic transfer impedance significantly lower than that of the plurality of first apertures.

18. The method of claim 17, wherein the expansion chamber is a first expansion chamber, and the external housing further comprises a second expansion chamber having all the limitations of the first expansion chamber, wherein the outlet of the first expansion chamber communicates with the inlet of the second expansion chamber.

* * * * *